United States Patent [19]

Rakocy et al.

[11] 4,283,979

[45] Aug. 18, 1981

[54] ADJUSTABLE SLICING BLADE ASSEMBLY

[75] Inventors: William J. Rakocy, Nutley, N.J.; Silvio Bellotti, New Hyde Park, N.Y.

[73] Assignee: North American Philips Corporation, New York, N.Y.

[21] Appl. No.: 56,169

[22] Filed: Jul. 10, 1979

[51] Int. Cl.[3] ..... B26D 7/26

[52] U.S. Cl. ..... 83/666; 83/676; 83/698; 83/699; 83/591; 83/592; 241/92

[58] Field of Search ..... 83/666, 665, 676, 699, 83/698, 355, 356, 437, 591, 592; 241/92

[56] References Cited

U.S. PATENT DOCUMENTS

| | | | |
|---|---|---|---|
| 1,898,160 | 2/1933 | Aeschbach | 83/665 |
| 2,169,323 | 8/1939 | Martinet | 83/591 |
| 2,958,354 | 11/1960 | Waig | 83/665 |
| 2,970,622 | 2/1961 | Lumdell | 83/666 |
| 3,066.714 | 12/1962 | Qualheim | 83/592 |

*Primary Examiner*—Donald R. Schran
*Attorney, Agent, or Firm*—Thomas A. Briody; William J. Streeter; Rolf E. Schneider

[57] ABSTRACT

An adjustable slicing blade assembly comprises basically a slicing or spacer disk having a centrally disposed circular opening, a cylindrical flange extending from the under side of the spacer disk and surrounding the circular opening, and a rotatable shaft axially movable within the cylindrical flange and through the circular opening and having a slicing blade extending radially from its upper end. Appropriate mechanism is provided to locate the spacer disk and the shaft in a given position with respect to each other. Associated with the shaft and cooperating with such locating mechanism is an arrangement for maintaining such given position and also varying the same and thereby the separation between the slicing blade and the spacer disk.

8 Claims, 5 Drawing Figures

ADJUSTABLE SLICING BLADE ASSEMBLY

This invention relates to an adjustable slicing blade assembly that is particularly adapted for use in conjunction with a food-processing apparatus.

Food-processing apparatus or food processors of varying degrees of versatility have become quite common of late. Such a device typically is provided with a bowl for containing the food item or items being treated or processed, such food items being introduced into the bowl through a suitable tube associated therewith.

Various attachments are removably positioned within the bowl for processing the food. Such attachments are so formed or designed as to chop, grate, shred, slice, mix, whip, knead, blend, puree, or otherwise process the food introduced into the bowl. One of these attachments usually is a disk provided with a blade for slicing a variety of foodstuffs.

In the use of such a slicing blade, it is often desired to slice different types of foods in different thicknesses. More or less thick slices can be obtained, of course, by utilizing a corresponding number of slicing blades. Such arrangement is cumbersome and otherwise undesirable especially from the storage point of view.

The proposal has been made to employ only one slicing blade for this purpose and to provide for adjusting its position with respect to the slicing disk. Such construction usually involves the use of a set screw or similar device to maintain the blade in a selected position in relation to the slicing disk. An arrangement of this type is generally unsatisfactory, however, as regards dependability and thus safety since the set screw is subject not only to undue wear but is also likely to work loose particularly at the speed at which a food processor is operated. Other systems that have been suggested are equally undesirable for one reason or another.

It has now been found that these disadvantages can be avoided through the provision of an adjustable slicing blade that can be positively positioned in place. This objective is accomplished in accordance with the invention by basically providing a slicing or spacer disk having a centrally disposed circular opening, a cylindrical flange extending from the under side of the spacer disk and surrounding such circular opening, and a rotatable shaft axially movable within the cylindrical flange and through the circular opening and having a slicing blade extending radially from its upper end. Appropriate mechanism is provided to locate the spacer disk and the shaft in a given position with respect to each other. Associated with the shaft and cooperating with such locating mechanism is an arrangement for maintaining such given position and also varying the same and thereby the separation between the slicing blade and the spacer disk.

Such system is surprisingly convenient and easy to operate and unusually free of maintenance difficulties. It can be readily cleaned and otherwise maintained in good working order with a minimum demand on time. Moreover, a plurality of different slice thicknesses can be obtained by simple adjustment of the slicing blade position-varying arrangement without disassembling and again assembling the apparatus. These advantages are realized, in addition, with improvement in the operating safety of the device as a whole.

The invention will now be described in greater detail in connection with the accompanying drawings in which.

Figure 1:
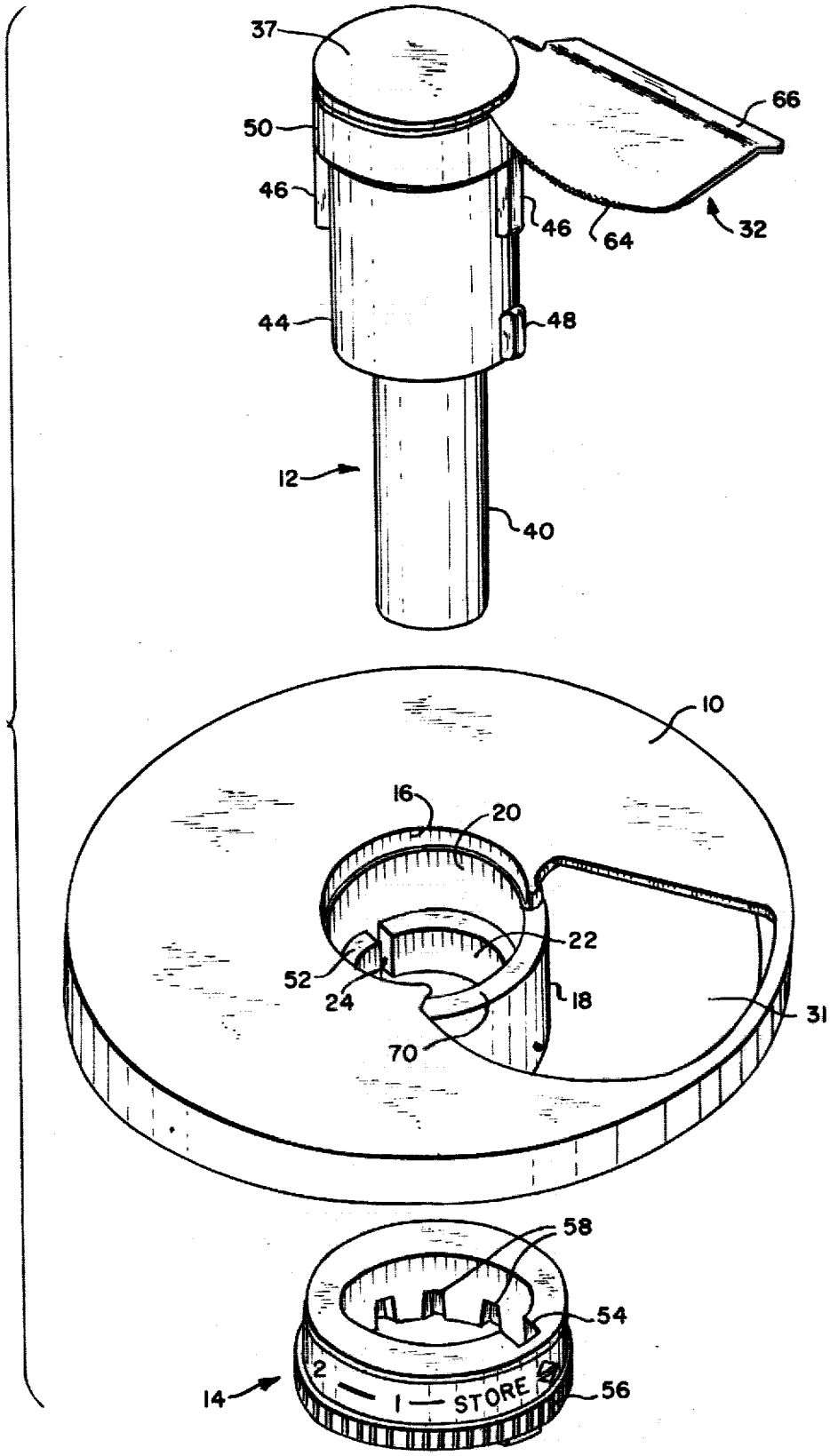
FIG. 1 represents an exploded perspective view of a preferred embodiment of an adjustable slicing blade assembly in accordance with the present invention.
Figure 2:
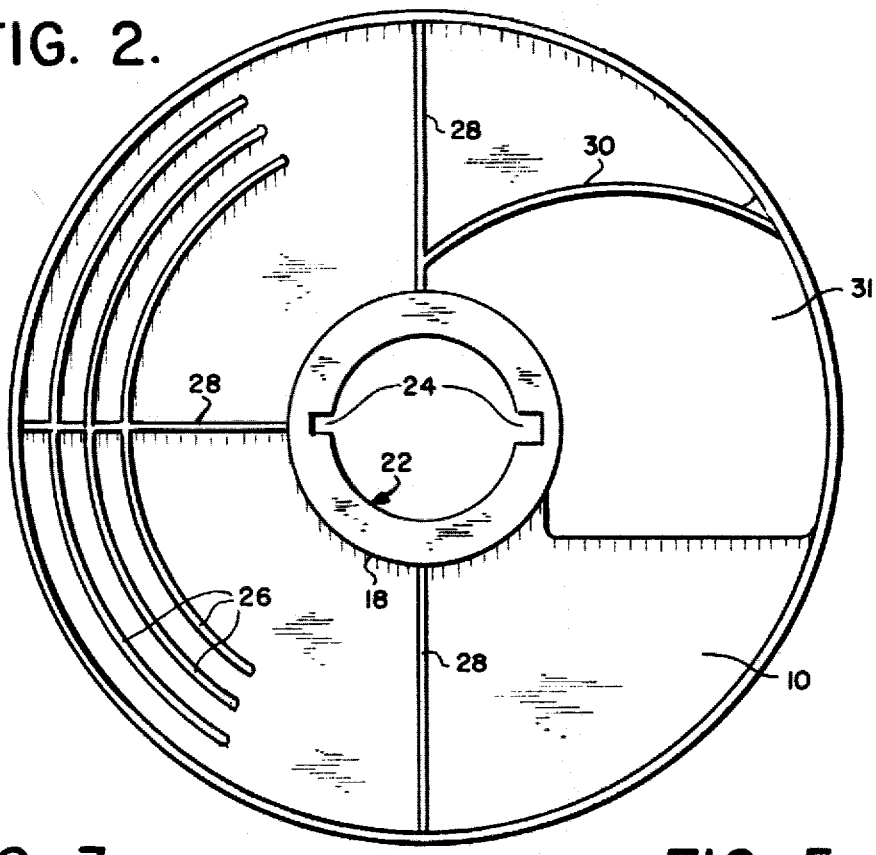
FIG. 2 is a bottom plan view of the spacer disk shown in FIG. 1.
Figure 3:
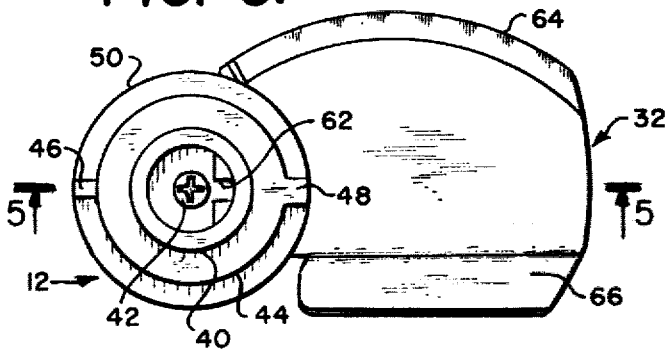
FIG. 3 is a bottom plan view of the rotatable shaft and the slicing blade shown in FIG. 1.
Figure 5:
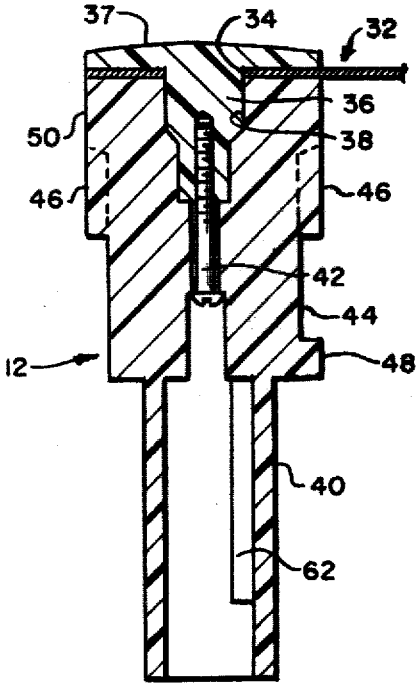
FIG. 5 is a diametrical sectional view of the rotatable shaft shown in FIG. 1, with part of the slicing blade broken away, such view being taken along line 5—5 of FIG. 3.
Figure 4:
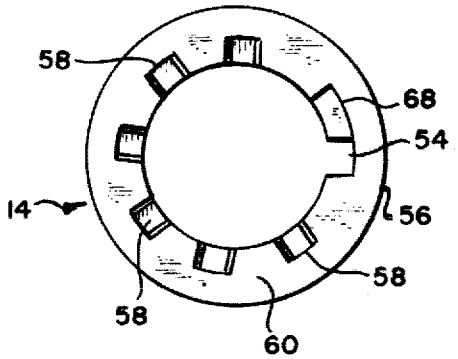
FIG. 4 is a bottom plan view of the adjustment ring shown in FIG. 1.

As shown in FIG. 1, the indicated adjustable slicing blade assembly comprises a spacer disk 10, a rotatable shaft 12, and an adjustment ring 14. The spacer disk 10 is formed with a centrally disposed circular opening 16, surrounding which is a cylindrical flange 18 extending from the under side of the disk. Projecting inwardly from the inner surface 20 of such flange is an axially extending shoulder 22, which is provided with a pair of preferably diametrically opposed axially extending slots 24. To afford additional strength to the spacer disk, which is desirably made of a suitable plastic, its under side is advantageously formed with various reinforcing ribs such as 26, 28, and 30. In addition, disk 10 is provided, for a purpose to be described later, with an opening 31 corresponding in shape substantially to that of the slicing blade 32.

Rotatable shaft 12 has a length sufficient to enable it to extend from well below flange 18 to above the top side of spacer disk 10 regardless of the desired spacing between slicing blade 32, which extends radially from the upper end of such shaft, and the disk 10. For attachment to the shaft, blade 32 is provided with a rectangular opening 34, throughwhich extends peg 36 having a corresponding cross section and projecting from the under side of shaft cap 37. Peg 36 is received in the recess 38, having the same cross section, formed in the body of the shaft and opening axially downwardly into the hollow lower portion 40 of the shaft. A screw 42 or the like engages the peg 36 to hold the blade 32 firmly in place.

The intermediate portion 44 of the rotatable shaft has a diameter such that it axially slidingly engages the shoulder 22, the shaft being designed to be axially movable within the cylindrical flange 18 and its shoulder and through the circular opening 16. A pair of preferably diametrically opposed axially extending ribs 46 is provided on such intermediate portion for respective sliding engagement with the shoulder slots 24. A knob 48, preferably in alignment with one of the ribs 46, is also provided on the intermediate portion of the shaft.

The upper portion 50 of the shaft has a diameter corresponding to the internal diameter of the cylindrical flange 18 so that it can engage the top 52 of shoulder 22 as necessary. Advantageously, the shaft is made of the same plastic as the spacer disk 10.

Adjustment ring 14 has an inner diameter such that it can be axially slid over the intermediate portion 44 of the shaft. An axially extending slot 54 is provided on its inner surface for engagement with the knob 48, which is preferably spaced from its aligned rib 46 a distance slightly greater than the axial width of such ring. In this manner, after the adjustment ring has been slid over knob 48 onto shaft portion 44, it can be manually rotated about the shaft. A knurled or fluted flange 56 is provided on ring 14 to assist in such rotation.

Ring 14 is also provided on its inner surface with a plurality of axially extending recesses 58 opening through its under side 60. These recesses are respectively of varying axial depth and are arranged for selective engagement by knob 48 once the ring has been slid over such knob and rotated. In this way the shaft assumes respectively corresponding positions with respect to flange 18 so that varying separations between slicing blade 32 and spacer disk 10 are obtained.

Rotation of shaft 12 is effected by placing its hollow lower portion 40 over a drive spindle (not shown). For this purpose the inner surface of hollow portion 40 may be provided with a keyway 62 for engagement with a key or the like on the drive spindle.

Upon rotation of shaft 12, the leading edge 64 of blade 32, which is usually formed from a metal such as a stainless steel, effects the desired slicing action, the thickness of the resulting slices depending, of course, on the spacing between such blade and spacer disk 10, such spacing being in turn determined by the setting of adjustment ring 14. Opening 31 in disk 10 is designed to receive and pass the sliced material downwardly. The trailing edge of blade 32 is advantageously formed with a downwardly bent extension 66 to guide the sliced material in such direction.

The under side ring 14 is also provided with a beveled protrusion 68 for engagement by knob 48 when the ring has been substantially completely rotated. (As shown in FIG. 1, the ring is designed to be rotated clockwise, with the thinnest slice being obtained when knob 68 engages the recess 58 at indicator "1".) Thus, as knob 48 comes into contact with protrusion 68, the former rides up on the latter and locks the shaft and its slicing blade against movement. Desirably, at that point the position of shaft 12 is such that the slicing blade is below the top surface of the spacer disk, with the result that not only is the slicing blade protected against damage but the assembly as a whole is rendered safe while not in use. To enable the slicing blade to be so positioned below the top surface of the spacer disk, the circular opening 16 is cut away at 70 adjacent opening 31.

As will be appreciated, if ring 14 is designed to be rotated counterclockwise, beveled protrusion 68 would be provided on the top side of ring 14 for engagement by the rib 46 in alignment with knob 48.

The leading or cutting edge 64 of slicing blade 32 is desirably serrated as indicated. It may, of course, be smooth; or it may be variously otherwise formed to provide slices having other than flat configurations.

What is claimed is:

1. An adjustable slicing blade assembly, which comprises a spacer disk having a centrally disposed circular opening; a cylindrical flange extending from the under side of said spacer disk and surrounding said circular opening; an inwardly projecting, axially extending shoulder on the inner surface of said cylindrical flange; one or more axially extending slots provided in the inner surface of said flange; a rotatable shaft axially movable within said cylindrical flange and through said circular opening, said shaft including an axially extending portion having a diameter less than the maximum diameter of said shaft such that said portion axially slidingly engages said shoulder; one or more axially extending ribs provided on said shaft for respectively engaging said one or more flange slots; a slicing blade extending radially from the upper end of said shaft; an adjustment ring having an inner diameter enabling it to be axially slid over said lesser diameter portion of the rotatable shaft; a knob protruding from said lesser diameter portion of the rotatable shaft; an axially extending slot provided on the inner surface of said adjustment ring for engaging said knob and thereby enabling said ring to be slid onto the rotatable shaft into a position above said knob; and a plurality of axially extending recesses provided on the inner surface of said adjustment ring and opening through the under side of said ring; said recesses respectively being of varying depth and arranged for engagement by said knob, whereby the separation between the slicing blade and the spacer disk may be varied.

2. An assembly according to claim 1, in which the upper end of the shaft has said maximum diameter and engages the top of the shoulder.

3. An assembly according to claim 1, in which the flange slots are provided in the shoulder, and the ribs are provided on the lesser diameter portion of the shaft.

4. An assembly according to claim 3, in which the shoulder is provided with two diametrically opposed slots, and the lesser diameter portion of the shaft is provided with two diametrically opposed ribs.

5. An assembly according to claim 3, in which the knob is in axial alignment with a rib, the separation therebetween being slightly greater than the axial width of the adjustment ring to permit rotation of said ring about the shaft.

6. An assembly according to claim 5, in which the spacer disk is provided with an opening corresponding in shape to the slicing blade, and the top side or the under side of the ring is provided with a beveled protrusion for engagement respectively by said rib or said knob to lock the shaft in position with the slicer blade in said opening below the top surface of the spacer disk.

7. An assembly according to claim 1, in which the spacer disk is provided with an opening for receipt and downward passage of sliced material.

8. An assembly according to claim 7, in which the leading edge of the slicing blade is a cutting edge, and the trailing edge of said blade is provided with a downwardly bent extension for guiding the sliced material into and through said opening.

* * * * *